US011769471B1

(12) United States Patent
Buswell

(10) Patent No.: US 11,769,471 B1
(45) Date of Patent: Sep. 26, 2023

(54) BARRE CHORD DEVICE

(71) Applicant: Arthur Buswell, Lisle, IL (US)

(72) Inventor: Arthur Buswell, Lisle, IL (US)

( * ) Notice: Subject to any disclaimer, the term of this patent is extended or adjusted under 35 U.S.C. 154(b) by 0 days.

(21) Appl. No.: 17/829,745

(22) Filed: Jun. 1, 2022

(51) Int. Cl.
*G10D 3/053* (2020.01)

(52) U.S. Cl.
CPC ..... *G10D 3/053* (2020.02)

(58) Field of Classification Search
CPC ..... G10D 3/053
See application file for complete search history.

(56) References Cited

U.S. PATENT DOCUMENTS 3,638,525 A * 2/1972 Sciurba ..... G10D 3/00 84/322
5,390,371 A * 2/1995 Sigward ..... A41D 19/00 2/161.6
6,393,616 B1 * 5/2002 Woodard ..... A41D 19/01517 2/163
8,269,084 B2 * 9/2012 Ludwig ..... G10D 3/053 84/315
9,892,653 B1 * 2/2018 Hansen ..... G09B 15/06

* cited by examiner

*Primary Examiner* — Robert W Horn
(74) *Attorney, Agent, or Firm* — Erickson Law Group, PC

(57) ABSTRACT

A barre chord device can include a strip of rubber, elastomeric or other resilient material with heat formed creases and protruding shims. A guitar player attaches the strip at discrete places to the index finger of his fretting hand. When the guitar musician performs a barre chord, the strip concentrates barre force to the strings. Shims press into the concave mid-finger keeping the strip straight on a string side to provide uniform barre pressure. Muscular effort is minimized. Creases cause the strip to fold neatly to a thumb side when the index finger is curled to perform non-barre chords and scales.

16 Claims, 13 Drawing Sheets

BARRE CHORD DEVICE

BACKGROUND

Guitar, piano, organ and accordion are the major instruments which can sound multiple notes at once. The guitar is capable of complex music including whole chords and melody over bass notes. Of all the harmonic instruments the guitar is the most portable. There were approximately 2.7 million guitars sold in the US in the year 2020.

Single note instruments (trumpet, sax, clarinet, etc.) may sound pleasing together in a band; alone these instruments may sound monotonous. A lone guitar with its six strings can hold the listener's interest with single note melody alongside major, minor and dissonant musical intervals. A "barre chord" is a type of chord played on a guitar by the use of one or more fingers pressed down on multiple strings across a single fret of the guitar. To "barre" is to undertake a barre chord. Many more intervals and chords become available to the player who can barre anywhere on the guitar neck.

Guitars differ with regards to string spacing and string tension. These differences affect the effort required to barre. String spacing on all guitars widens gradually from the guitar-nut 121 (FIG. 12) to the guitar-saddle 101 (FIG. 10A). The width of the nut itself is the parameter used to compare string spacing among types of guitars. Steel string guitar models, including solid body, hollow-body electric and acoustic, all measure 1¾" at the nut. Nylon crossovers measure 1⅞" at the nut and the widest string spacing occurs on nylon classical guitars with a 2" nut width.

An average-teenager has enough strength to perform a full six-string barre on a solid-body electric guitar strung with low-tension steel strings. In addition, players of all narrow neck models have an alternate barre fingering option. Rather than using the index finger alone, they can use a combination of index finger and thumb with the thumb reaching over the neck to depress one or two bass strings. A device to assist barre chords may not be required for steel-string solid-body electric guitars strung with low tension strings.

Although steel-string hollow-body electric guitars have the option of amplification, their owners also want to hear the instruments unplugged. Achieving some acoustic volume necessitates higher tension strings in comparison to solid body guitars. Thus, there is a step up in the mechanical force required to perform a six-string barre. For these hollow-body electric guitars, some players may be strong enough to barre them without any aid. Some players might prefer the alternate thumb-over-the-neck fingering. Some players might prefer a device to reduce the effort of performing a barre chord.

Steel-string acoustic guitars are expected to produce sufficient volume without amplification. This results in yet higher tension strings and more difficulty for musicians wishing to barre. Again, the narrow neck allows the alternative thumb-over-the-neck barre fingering. This category of guitar is very demanding for barre chords.

The wide string spacing and wide neck of nylon-crossover and classical guitar models may eliminate the possibility of thumb-over-the-neck fingering for all but the tallest of men. On these guitars one's index finger is the only option to barre. Not only that, but the wider string spacing means that the middle segment of the index finger will be required to depress one or more strings.

The strings and finger board of a nylon string guitar lie in a flat plane. Those of an acoustic guitar conform to an imaginary cylinder-cutout of a given "finger-board radius." The front of the bare index finger is not as smooth as either of these geometric shapes.

The middle phalanx bone is deep into the finger behind soft tissue. The bony joints at either end of the middle phalanx are more prominent. Thus, as the index finger increases pressure to barre, those strings under joints are usually sufficiently depressed to produce a clear sound. At the same time, strings under the middle phalanx dig into soft tissue and may not produce a clear sound. Only after additional pressure is brought to bear across the entire index finger will the middle phalanx bone push through soft tissue with enough force to sound the corresponding string or strings.

For the player who barres with his bare finger there is the issue of exactly where barre pressure can be applied successfully. It is desirable to achieve firm contact of the guitar strings to a narrow fret. However, to play properly, no flesh of the bare finger should overlap the fret as that would diminish tone, or worse, dampen vibrating strings.

Observe the bare finger barre in FIG. 12 at first fret 120. Even as firm contact of guitar strings to a narrow fret 120 is desirable, the force from the distal, middle, and proximal phalanx bones is more than half-a-finger-width away. Furthermore, the width of the index finger means that a broad arcs of the strings around the index must be compressed at the expense of great effort. Barring with a bare finger is a matter of strength.

U.S. Pat. Nos. 8,269,084 and 5,390,371 describe guitar aids for performing barre chords, or covering all of the guitar strings. These two patents are incorporated by reference to the extent that they are not contrary to the present disclosure. A player using a model designed from either of these patents may not be able to apply uniform pressure across all six strings in barre chord formation. In addition, both U.S. Pat. Nos. 8,269,084 and 5,390,371 position material to the palm side of the left index finger. Upon attempting to bring the fingertip to fret strings 1 through 3, this material becomes trapped within the finger which cannot curl sufficiently. Other patents that are incorporated by reference to the extent that they are not contrary to the present disclosure are: U.S. Pat. Nos. 3,638,525; 3,854,368; 4,817,488; 5,390,371; 5,492,045; 5,515,762; 6,160,212; 6,369,307; 7,476,792; 9,741,320; 9,892,653; 10,403,245; 10,297,236; 6,393,616; and 8,269,084.

SUMMARY

An exemplary embodiment of the invention provides a resilient strip attached to the index finger of a (right-handed) guitar player's left hand. The strip is located down the front length of the finger, rotated sightly to the thumb side with a region of the strip below the proximal phalanx. Barre pressure applied by the index finger through the strip concentrates force on the strings near the selected fret where needed for ideal string-to-fret contact. Attachment points to secure the strip to the index finger are located at strategic locations.

Guitar playing is not only about barre chords; the index finger must be free to bring fingertip to individual notes, and notes on the top three strings may require the index finger to be curled to its maximum extent. Without special design accommodation the strip would bunch up within the index finger and thwart attempts to curl the index finger as needed for notes on the individual strings.

The strip can include shape-memory creases formed by heat treatment. As the index finger is curled, a strategically placed mid-finger-attachment point and a strategically placed finger-tip-attachment point squeeze the strip, causing the strip to fold and twist toward the thumb side.

The front of the human index finger has prominent tip and middle joints and a depression of the middle phalanx in between. Shims are attached to the strip and are positioned to contact the index finger at the middle phalanx. The result is that strip is flat along its length for even barre chord pressure across all six guitar strings.

Players of Classical and nylon-stringed crossover guitars can perform six-string barre chords with reduced effort by employing an embodiment of the barre chord device. Players of high-tension steel-string models who are having difficulty with index-finger barre chords could well be helped also. A barre chord device embodiment reduces the effort required to perform a barre chord when compared to that same chord performed with a bare index finger. Yet the embodiment does not interfere with the left index finger as it frets individual notes with the fingertip. Index finger transition between barre chords and single notes is effortless, requiring no unnecessary movement.

Regarding reduced effort, observe the bare-finger barre chord at the first-fret 120 in FIG. 12. Notice the bare finger must be placed far enough away from the first-fret 120 so that no skin touches or overlaps the first-fret 120. As the index finger in FIG. 12 is flattened against the strings, notice skin-bulge 122 on the high-E string being close to spilling over and unintentionally dampening that string.

If the shape of the acoustic guitar body allows it to be held securely under a padded right forearm, the barre chord device of this patent may help.

For simplicity, right-handed play is assumed in the text and figures throughout this document. That means that while the left-hand frets notes and wears the barre chord device; the right hand plucks strings. In fabrication, a barre chord device can be made for the left-handed player as easily as for the right-handed player the difference being that shape-memory creases 12, 13 and 14 (FIG. 1) are mirror images of the right-handed version.

Numerous other advantages and features of the present invention will be become readily apparent from the following detailed description of the invention and the embodiments thereof, and from the accompanying drawings.

BRIEF DESCRIPTIONS OF THE DRAWINGS

DETAILED DESCRIPTION

Figure 1:
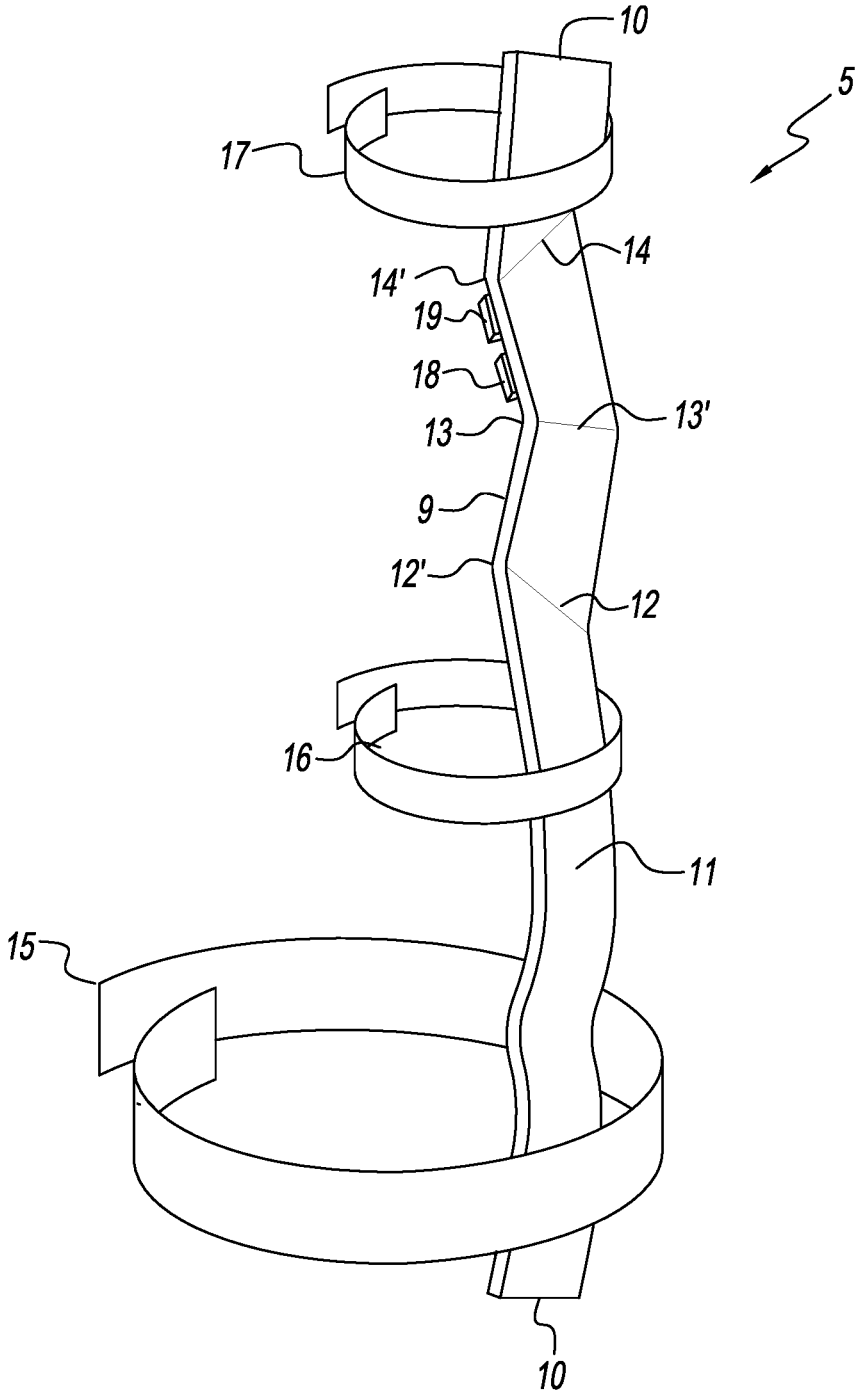
FIG. 1 is a perspective view of an exemplary embodiment of the barre chord device of the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Illustrations and text refer only to performance by a right-handed guitar player, for simplicity of description. It is equally applicable to left-handed guitar players with modification to the device.

A first embodiment of the barre chord device 5 is seen in perspective view in FIG. 1. A pressing strip 10 may be composed of natural rubber, synthetic rubber or another resilient material or resilient structure. The strip 10 includes a front side or "string side" 11 which contacts guitar strings during a barre chord.

Shape-memory creases 12, 13, 14 are incorporated into strip 10 by heat forming of a previously manufactured strip 10 or by high temperature fabrication of strip 10. Shape-memory crease 12 appears as an indentation running from upper left to lower right as seen in FIG. 1. The perspective viewing angle of FIG. 1 also reveals that shape-memory crease 12 causes a bulge 12' out on the back side (or finger side) 9 of the strip 10. Bulge 12' appears in the foreground of FIG. 13.

Shape-memory crease 13 is on the back side 9 of strip 10. Shape-memory crease 13 is in plain view in FIG. 13 running perpendicular to the length of strip 10; its corresponding bulge 13' is seen in FIG. 1.

Shape-memory crease 14 appears as an indentation running from lower left to upper right as seen in FIG. 1. The perspective viewing angle of FIG. 1 also reveals a corresponding bulge 14' out the back side 9 of the strip 10. Bulge 14' appears in the foreground of FIG. 13.

Figure 2:
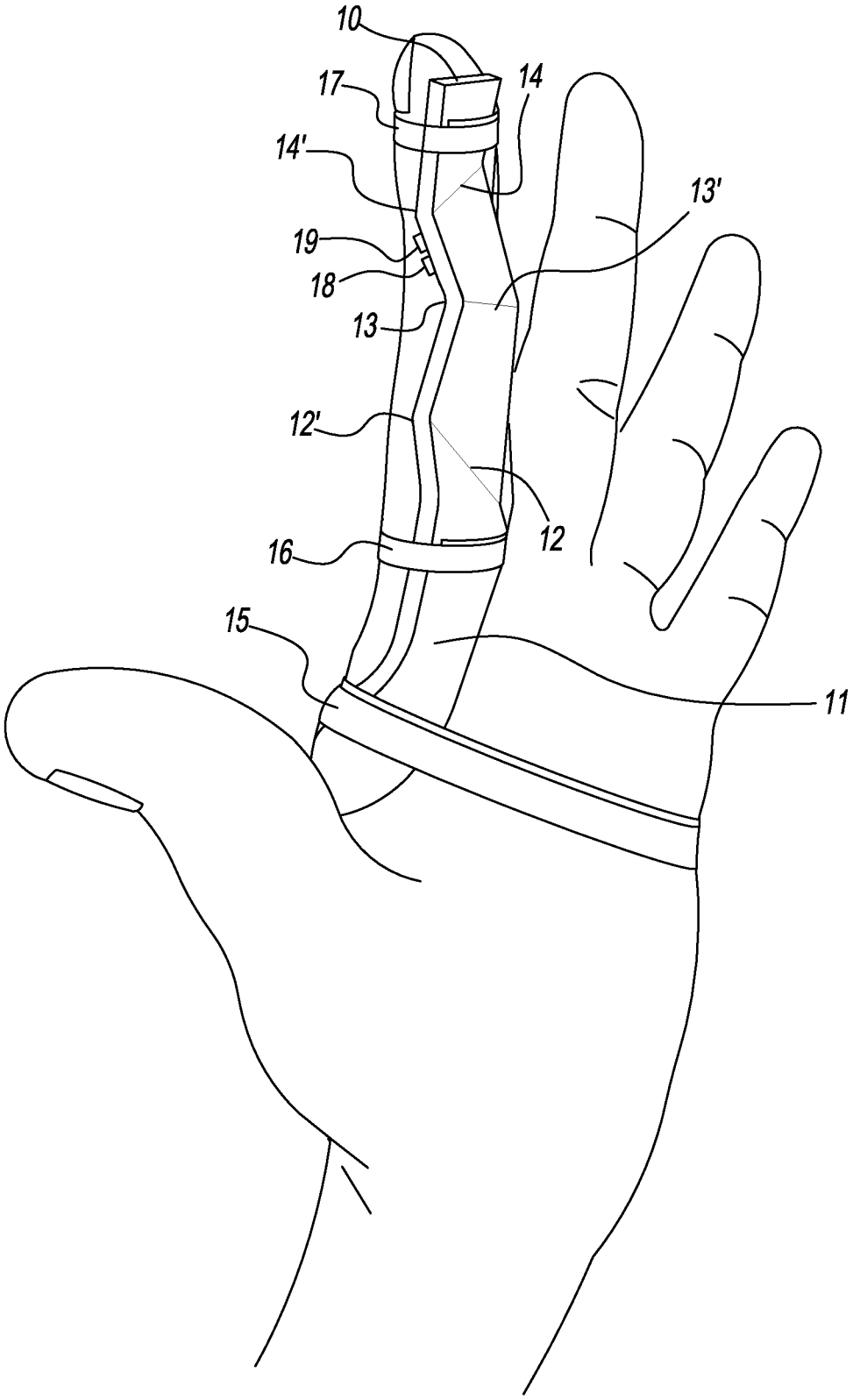
FIG. 2 is a perspective view of the exemplary embodiment of FIG. 1 mounted on a guitar player's left index finger.

Palm-tape 15, mid-finger-tape 16 and fingertip-tape 17 secure strip 10 to the left index finger of guitar player as seen in FIG. 2.

Shims 18 and 19 are attached to strip 10 as seen in FIG. 1. The shims can be composed of natural rubber, synthetic rubber or other suitable material. In FIG. 2, the strip 10 is mounted to left index finger for performance. Notice that shims 18 and 19 are placed to contact the mid-finger segment between the tip joint and the middle joint.

The middle phalanx of the index finger is recessed between the more prominent tip and middle joints so guitar strings impressed unaided by the middle phalanx receive less pressure and often do not sound. The shims 18, 19 shown in FIG. 1 build out the mid-finger segment to be equal in projection on the string side as the neighboring boney joints (the distal interphalangeal joint and proximal interphalangeal joint) so that equal pressure may be applied by the string-side 11 of the strip 10 across all six guitar strings.

Embodiments of the barre chord device are configured to not interfere with the left index finger when it is curled to bring fingertip into action on single notes or non-barre chords. The shape-memory creases 12, 13, 14 shown in FIG. 1 are pre-disposed fold lines in strip 10. As the index finger is curled, attachment points 16 and 17 compress the strip 10, and creases 12, 13, 14 become folds. Thus, strip 10 twists and bends off to the thumb-side of the index finger rather than being trapped within the curled index finger. This is demonstrated In FIGS. 5 and 6 where there is no guitar to obstruct the view and it is clear that strip 10 does not interfere with index finger curving as needed.

Figure 9:
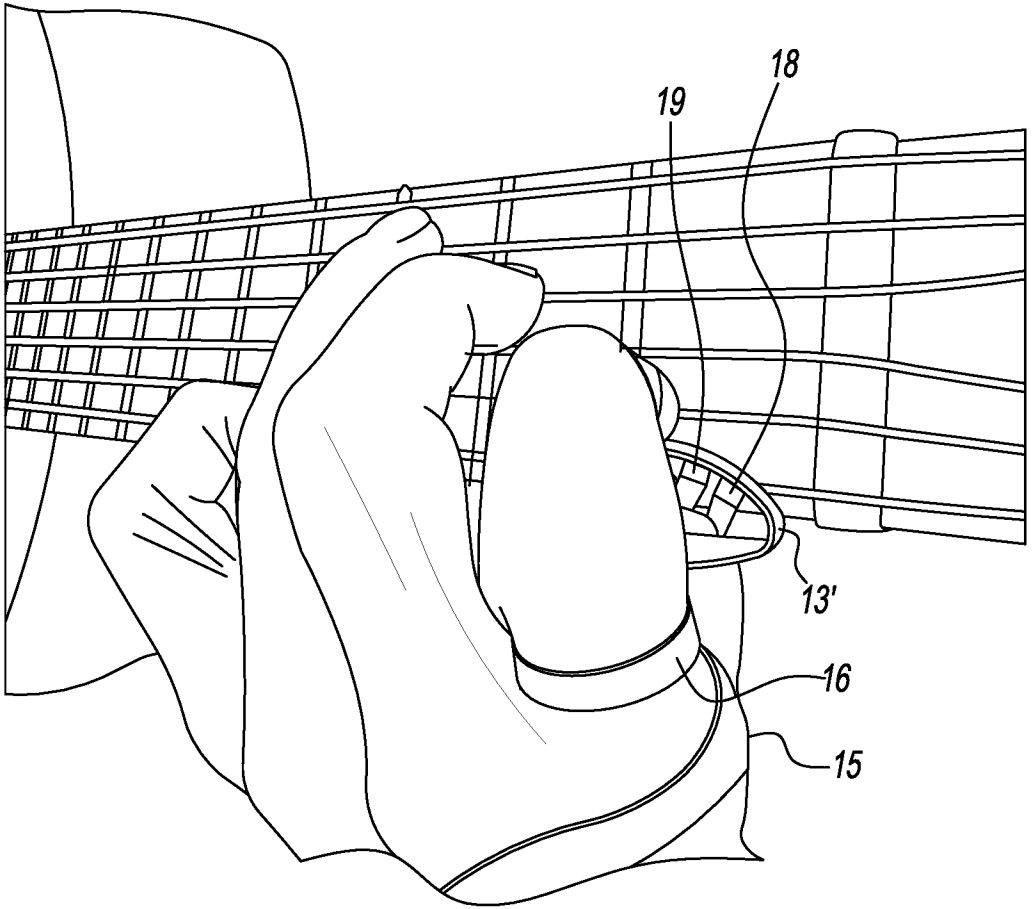
FIG. 9 is a perspective view of the exemplary embodiment of FIG. 1 mounted on a guitar player's left index finger and shown with the index finger curled to finger a C-major-chord.

FIG. 9 demonstrates that fingering of the major C chord is only possible because the strip 10 is bent off to the thumb side. When the index finger is held straight as in FIG. 2, shape-memory-ceases 12, 13, 14 are overcome; strip 10 is straight and a barre chord may be performed as in FIGS. 10A and 11A.

Figure 3:
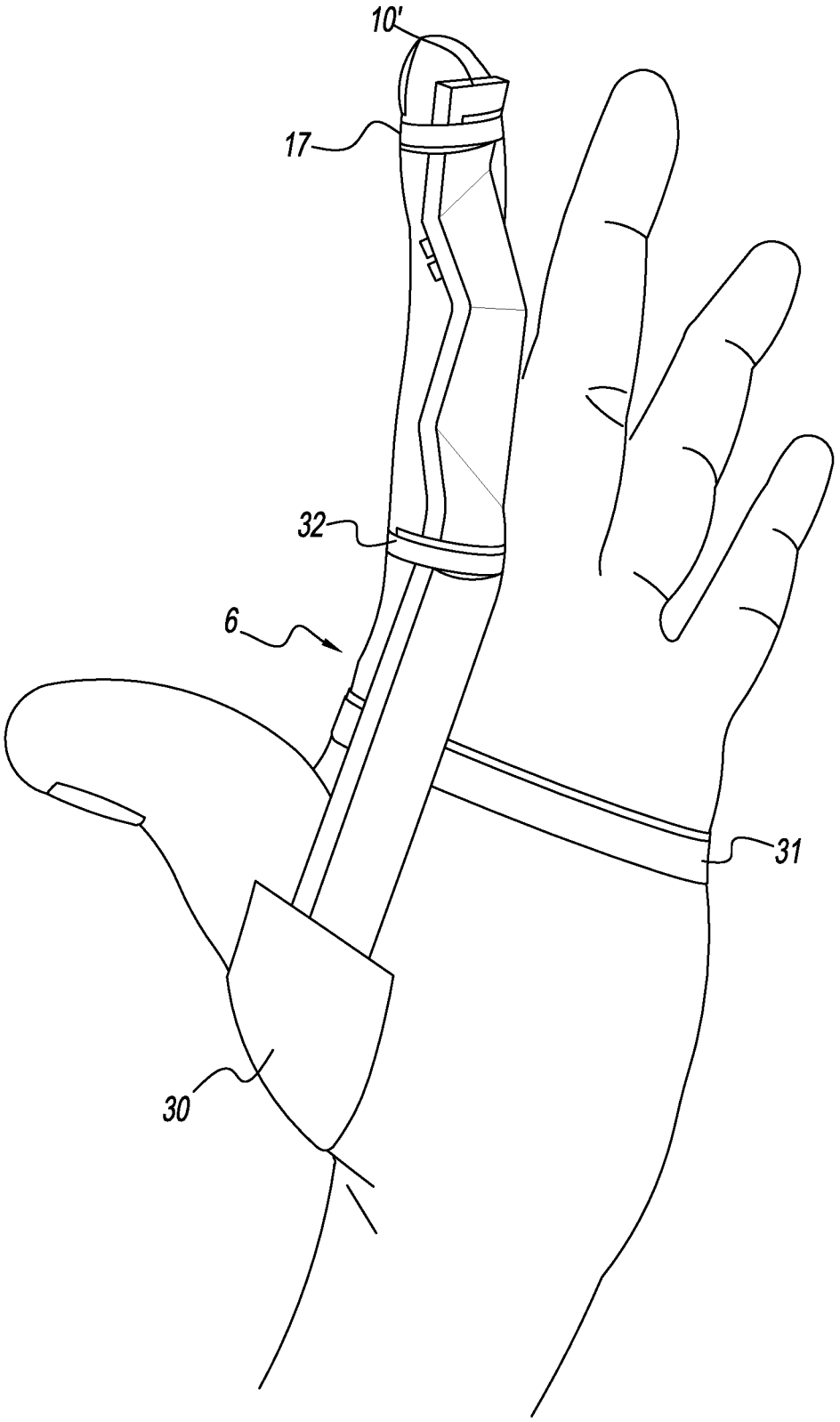
FIG. 3 is a perspective view of the exemplary embodiment of FIG. 1 mounted on a guitar player's left index finger and secured with tape and bands.

A second embodiment barre chord device 6 is shown in FIG. 3 and includes a long strip 10' reaching around the thumb-palm joint and secured there by tail-tape 30. Also in FIG. 3, palm band 31 replaces palm tape 15 of FIG. 2. Further, in FIG. 3 mid-finger band 32 replaces mid-finger tape 15 of FIG. 2. In all other aspects, the strip 10 and the strip 10' function the same.

Figure 4A:
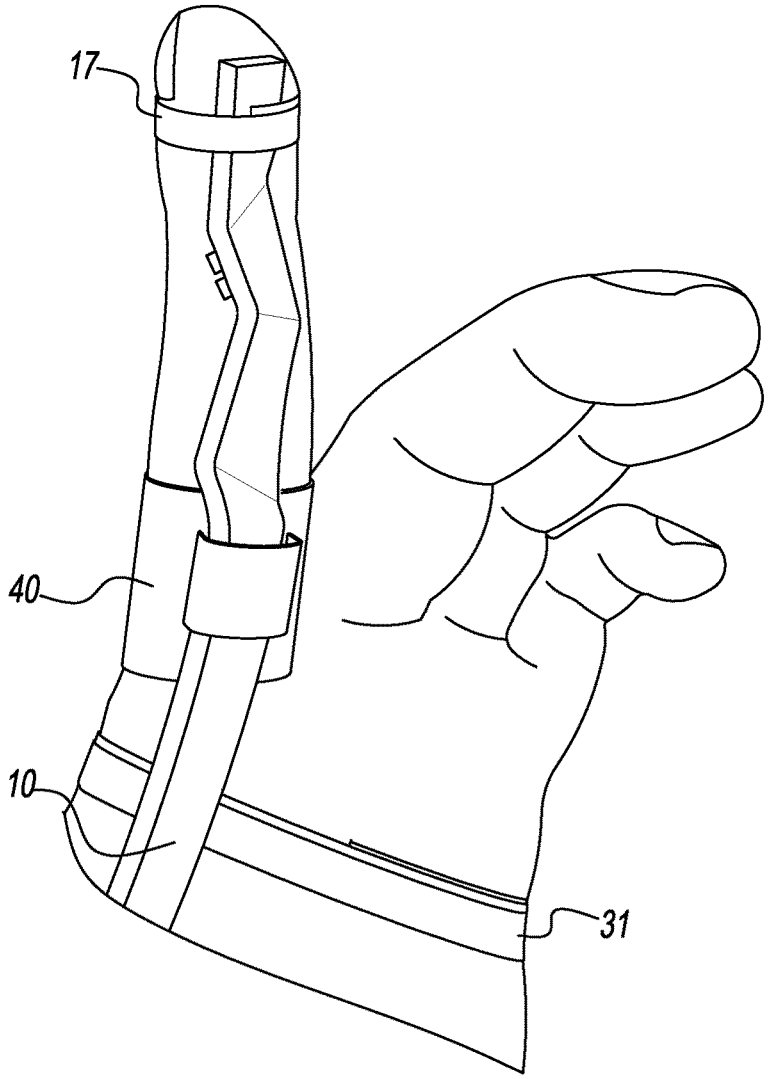
FIG. 4A is a perspective view of another exemplary embodiment of the invention mounted on a guitar player's left index finger and secured with tape and stretch cloth.
Figure 4B:
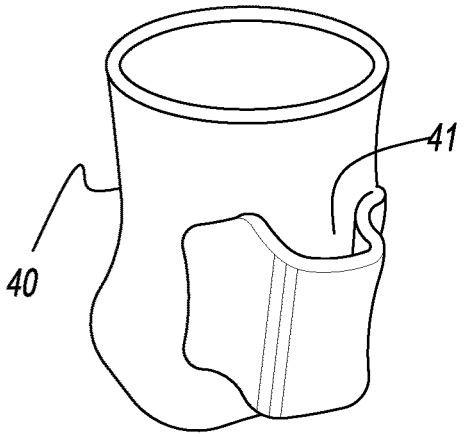
FIG. 4B is a perspective view of a mid-finger-sleeve-with-guide taken from FIG. 4A.

A third embodiment of FIG. 4A shows a mid-finger sleeve 40 securing strip 10 to the left index finger. FIG. 4B shows the mid-finger sleeve in a separate image. A loop guide 41 attached to or formed with the sleeve 40 has a channel which passes the strip 10 therethrough.

Fabrication of the Barre Chord Device

The strip 10 (or 10') of FIGS. 1-3 can be composed of Alliance® Rubber Company Supersize Band, Blue, 17". Embodiments are not restricted to Alliance® rubber; other natural or synthetic rubber, other elastomeric material or other resilient material or structure may be used. Dimensional proportions other than seen in the Figures may be used. In order to assure that strip 10 will twist and fold out of the way for non-barre chords and scales, it must be customized to the length of the player's index finger per FIG. 2. Some experimentation may be required to achieve optimal results. The strip 10 has the heat formed shape-memory creases 12, 13, 14. The shape-memory creases 12 and 13 should be heat formed so as to fit on either side of the middle finger joint as shown in FIG. 2. With FIG. 2 as a guide, shape-memory crease 14 should be heat formed so as to be just above the visible crease of the fingertip joint and shape-memory crease 13 should be heat formed midway between shape-memory creases 12 and 14.

Figure 7:
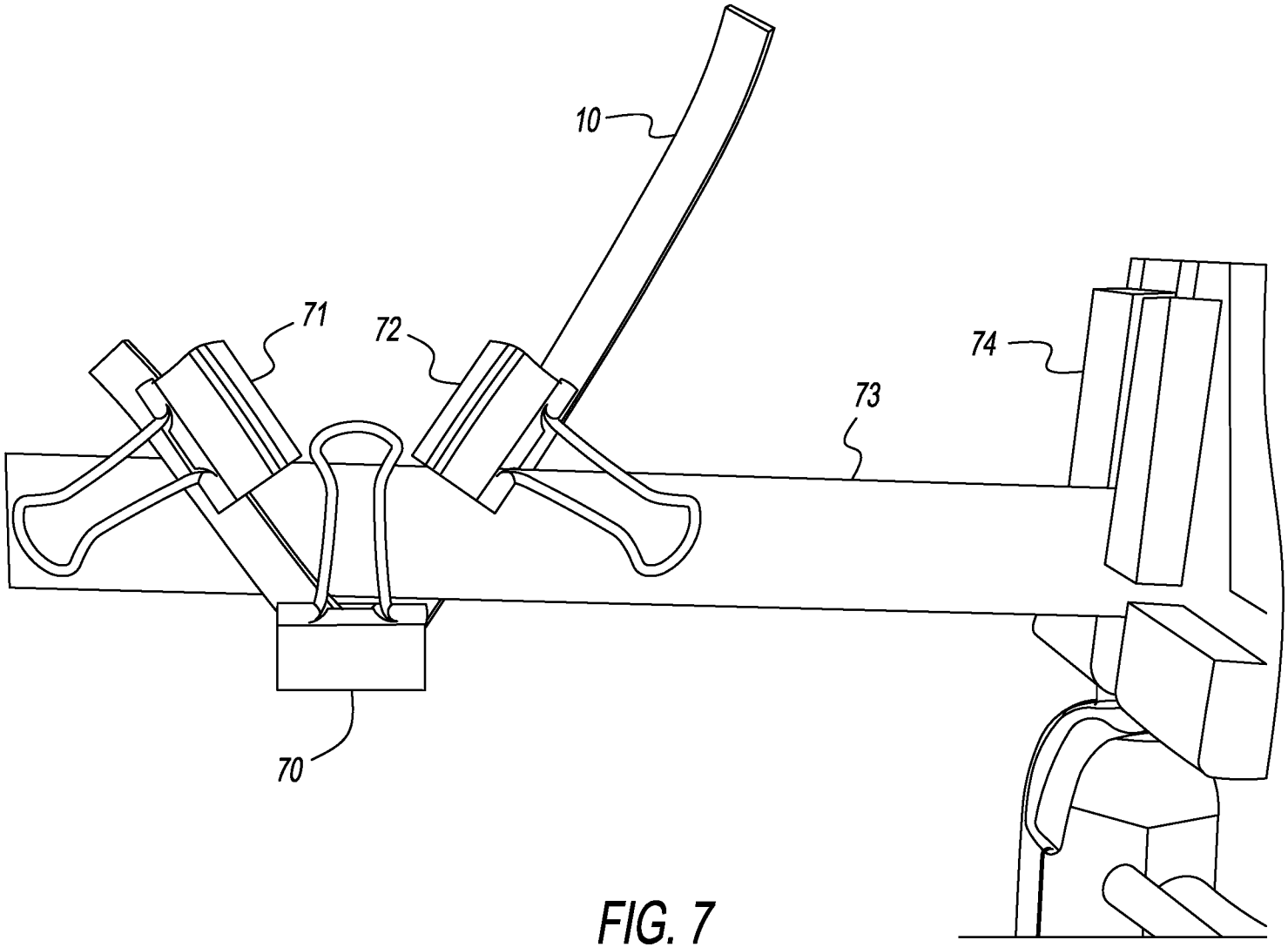
FIG. 7 is a perspective view of a first method step according to an exemplary method of the invention, showing a rubber strip prepared to burn shape-memory crease.
Figure 8:
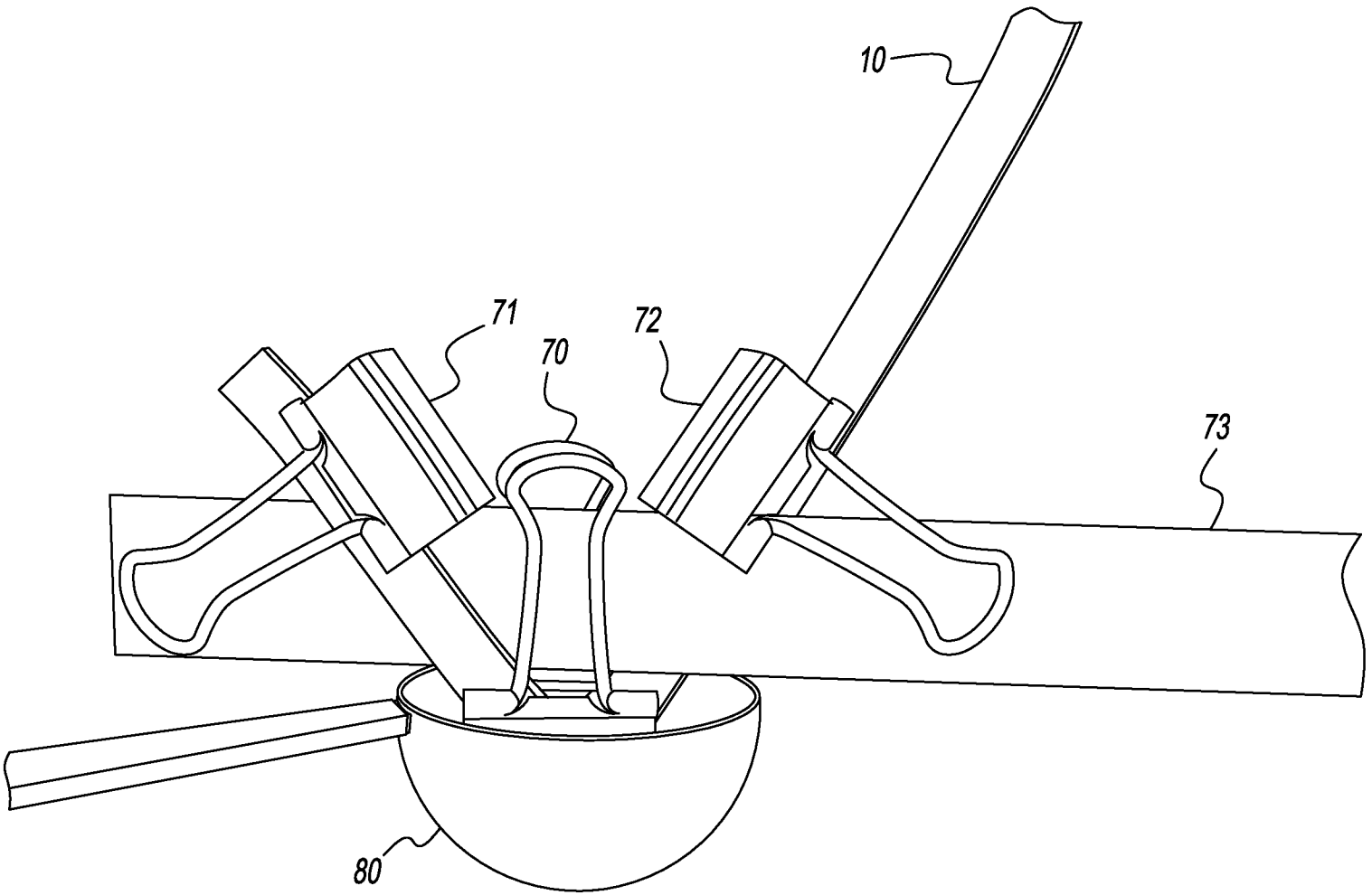
FIG. 8 is a perspective view of a second method step according to an exemplary method of the invention, showing a rubber strip prepared to heat form shape-memory crease.

Other embodiments may include any number shape-memory creases of any angle. Shape-memory creases 12, 13, 14 are heat formed by folding strip 10 inside clip 70 (FIG. 7) and immersing the fold in heated vegetable oil (FIG. 8). The hot oil is applied by a steel cup 80 as seen in FIG. 8. Oil temperature is near the melting temperature of rubber and immersion time is of the order of minutes. FIG. 7 shows strip 10 in preparation for heat forming. Although clamp 70 holds strip 10 into a tight fold, the resulting shape-memory crease appears as a gentle curve. In FIG. 7, clamps 71 and 72 hold strip 10 against a copper-bar 73 which acts as a forming jig. In FIG. 7, vice 74 supports copper bar 73.

In the embodiment of FIGS. 1-3, shims 18 and 19 can be Alliance® Rubber Company X-Treme™ File Bands or other suitable material. The shims 18, 19 are glued to strip 10 on the back side 9 to line up with the recessed middle segment of the index finger (the middle phalanx). Other embodiments could use alternate number(s) of shims, equal to or greater than one shim, of alternate dimensions, of other suitable material, located elsewhere on strip 10, including on the proximal phalanx and/or the distal phalanx. The shims, particularly if the shims 18, 19 and the strip 10 are all composed of rubber, could be formed as one piece with the strip 10 by a molding operation.

Attachment of strip 10 to index finger is seen in FIG. 2. Cloth medical tape cut to necessary width is shown for palm tape 15, mid-finger tape 16 and finger-tip tape 17. Any manner of tape may be used in other embodiments.

In FIG. 3, palm band 31 and mid-finger band 32 can be attached to the strip 10' with glue. Alternatively, bands 31 and 32 could be formed with the strip 10' as one piece by a molding operation. Bands may be made of rubber, natural or synthetic, other elastomeric material or other resilient material. Any number of bands may be used.

FIG. 4A shows a mid-finger sleeve 40 attached to the index finger. In this embodiment, the mid-finger sleeve 40 can be made of Spandex elastic fabric. It is fabricated with sewing techniques of the garment industry. Any fabric could be used in other embodiments.

Operations Section: Mount Barre Chord Device to Index Finger

Embodiments of the barre chord device can be mounted to the index finger as shown in FIG. 2 or 3. Note that the bottom edge of shape-memory crease 14 is just above the indented skin of the fingertip joint. Note that shims 18, 19 are opposite the mid-finger segment. Note that the top edge of shape-memory crease 12 is just below the bulge of the mid-finger joint. Be advised that the player needs enough exposed fingertip so as not to allow the strip 10 (or 10') to dampen adjacent stings when non-barre chords are played. Also notice in FIG. 2 that strip 10 (or 10') is not centered down the front of the index finger. Rather it is rotated slightly toward the thumb side. The reason is that bringing fingers 2, 3 and 4 to their assigned strings in a barre chord formation, results in the index rotating slightly so that barre pressure lands along the thumb side of the index finger.

FIG. 2 or 3 can be a first approximation from which players will customize the Barre chord device to their individual hand and their music repertoire.

Operations Section: Example Barre Chords A7 and Dm

Figure 13:
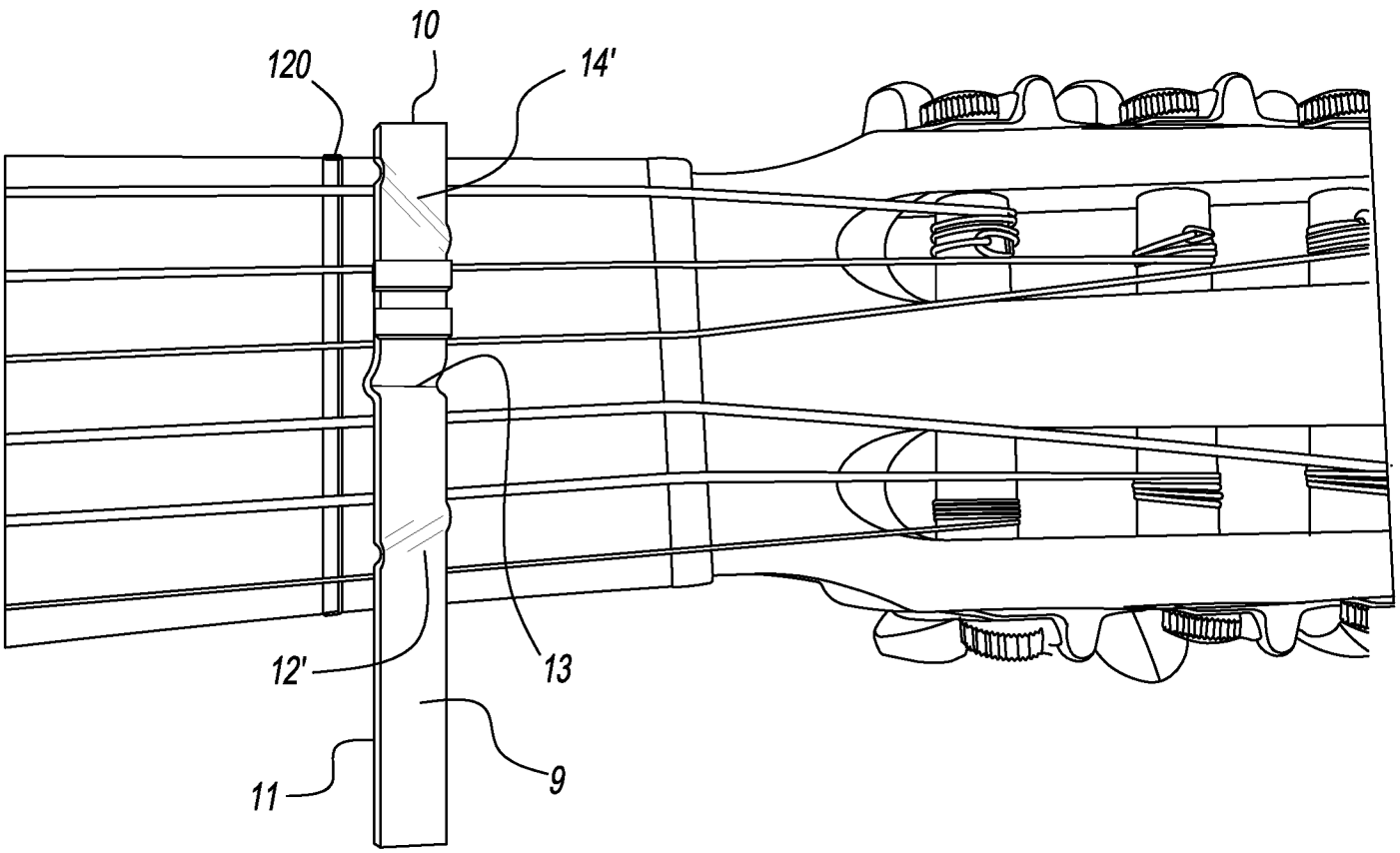
FIG. 13 is a perspective view of a portion of the exemplary embodiment of FIG. 1 showing contact of a rubber strip on guitar strings.

As seen in the embodiment of FIG. 1, shims 18 and 19 build out the concave mid-finger resulting in a smoother string-side 11 (FIG. 13). Thus, with the barre chord device, a player can apply uniform barre force across all six strings as in FIGS. 10A, 11A.

Figure 10A:
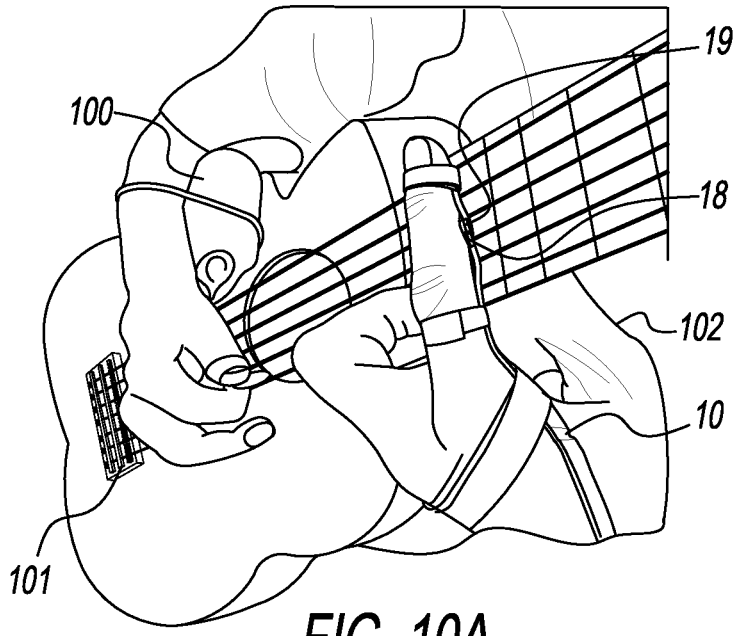
FIG. 10A is a perspective view of the exemplary embodiment of FIG. 1 mounted on a guitar player's left index finger and shown with the index finger fingering an A7-chord.
Figure 10B:
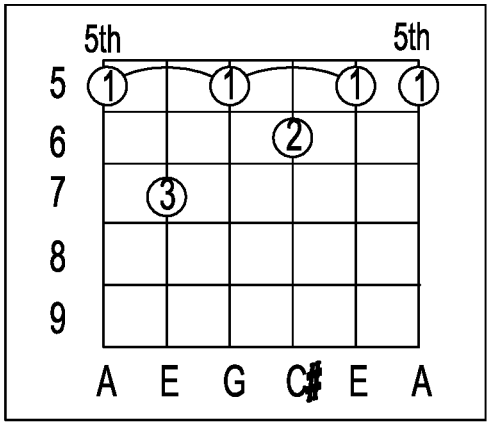
FIG. 10B is a guitar TAB for an A7-chord.
Figure 10C:
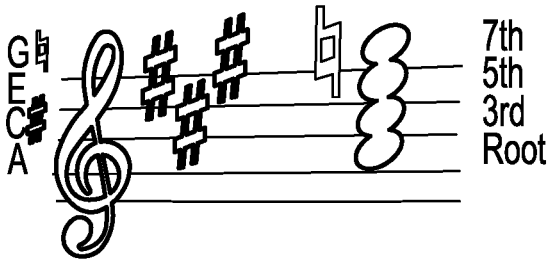
FIG. 10C is a score sheet for an A7-chord.

FIG. 10C shows the score-sheet for the A7 chord. The TAB for the A7 chord in FIG. 10B indicates that the barre is at the fifth fret. Notice that the barre does not need to sound the A string as the third finger has the E note at the seventh fret. However, it is necessary for the barre to sound the G. Indeed, it is the G note on the D string that makes the chord a seventh. The shim 18 applies that needed pressure as seen in FIG. 10A.

Figure 11A:
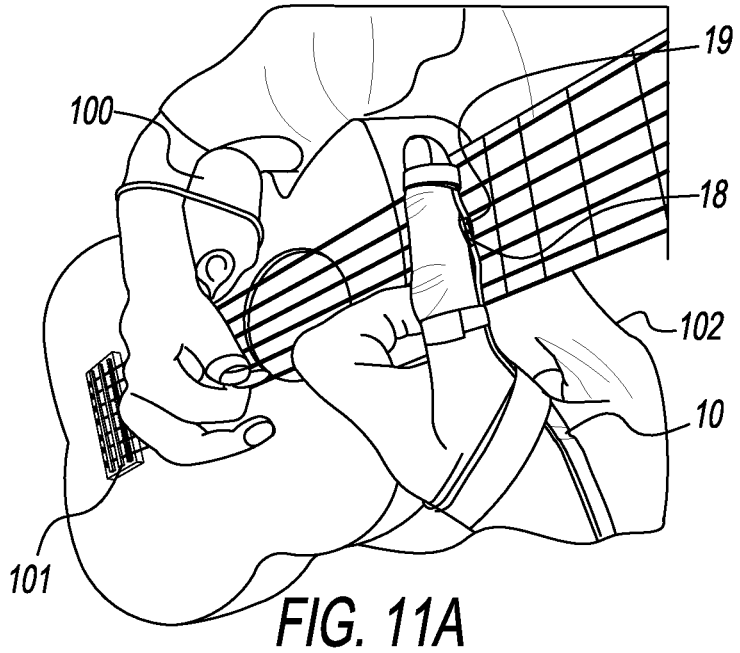
FIG. 11A is a perspective view of the exemplary embodiment of FIG. 1 mounted on a guitar player's left index finger and shown with the index finger fingering a Dm-chord.
Figure 11B:
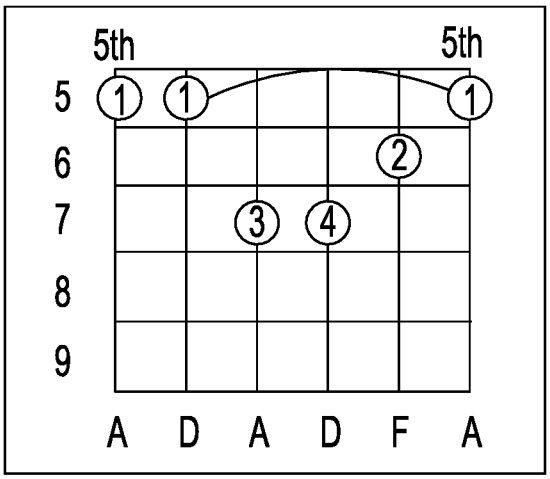
FIG. 11B is a guitar TAB for a Dm-chord.
Figure 11C:
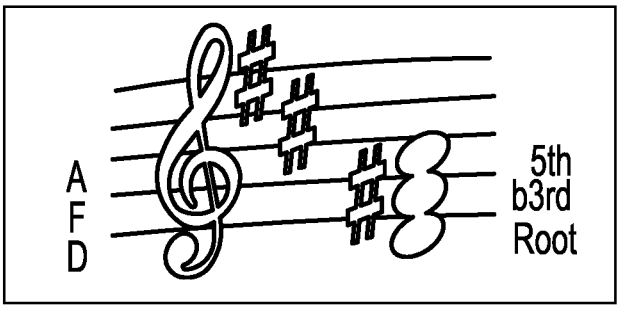
FIG. 11C is a score sheet for a Dm-chord.
Figure 12:
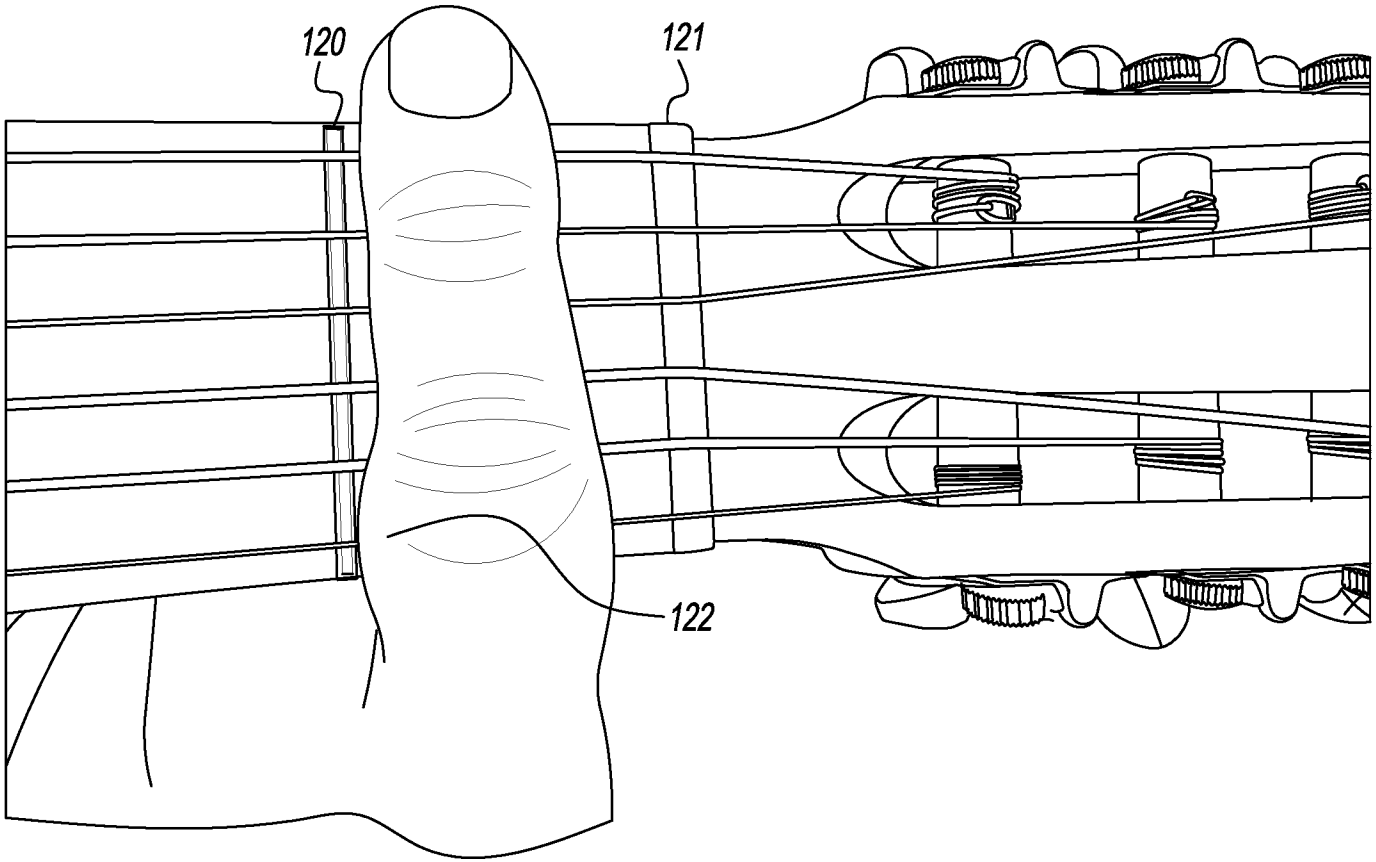
FIG. 12 (Prior Art)
FIG. 12 is a perspective view of a bare finger executing a barre chord.

FIG. 11C shows the score sheet for the Dm chord. The TAB for the Dm chord in FIG. 11B indicates that the barre is at the fifth fret. Notice that the barre does not need to sound the D string as the third finger has the A at the seventh fret. However, it is necessary for the barre to sound the D note on the A string. That D note is the root of the Dm chord. The shim 19 applies that needed pressure as seen in FIG. 11A.

Note that it is not necessary that shims 18 and 19 exactly line up with guitar strings. Those two shims build out the mid-finger segment sufficiently without exact alignment.

FIG. 13 represents a barre chord executed with an embodiment of the Barre chord device. The finger itself and attachment-points 15, 16, 17 are not included in FIG. 13 so there is a clear view of the finger-side 9 of strip 10. Notice in FIG. 13 the strip 10 (or 10') applying barre pressure where it is needed—close to first-fret 120. Notice further that strip 10 (or 10') is narrower than the human finger. An individual string depressed by strip 10 would resemble a "V" in its shape rather than a "U" as would be the case with the broad, bare finger. Essentially the strip 10 (or 10') forces down only the minimum arc of string to make firm contact with the desired fret thereby saving effort. The total muscular effort saved over six strings is considerable in comparison to a barre with the bare finger.

Operations Section: Scales and Non-Barre Chords

Figure 5:
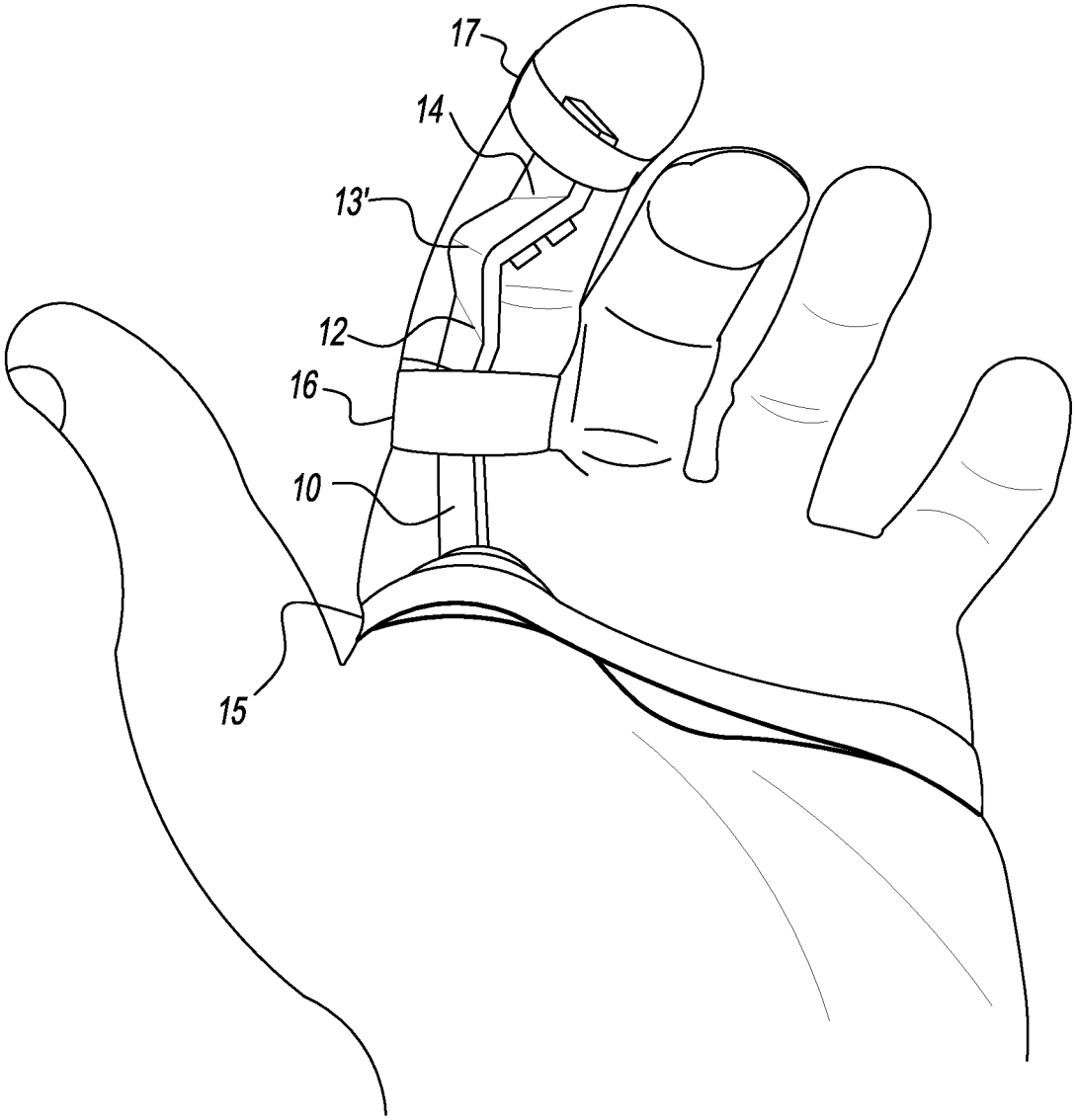
FIG. 5 is a perspective view of the exemplary embodiment of FIG. 1 mounted on a guitar player's left index finger and shown with the index finger half curled.

Embodiments of the barre chord device do not interfere with the index finger in performance of scales and non-barre chords. These non-barre chord formations often require the left index finger to curl so that the fingertip can fret an individual string. When that guitar string is the $1^{st}$, $2^{nd}$ or $3^{rd}$, the index must curl to its natural limit. In FIG. 5, the musician's left index finger is midway between playing a barre chord and playing a single note with the fingertip; the finger is partially curled.

Figure 6:
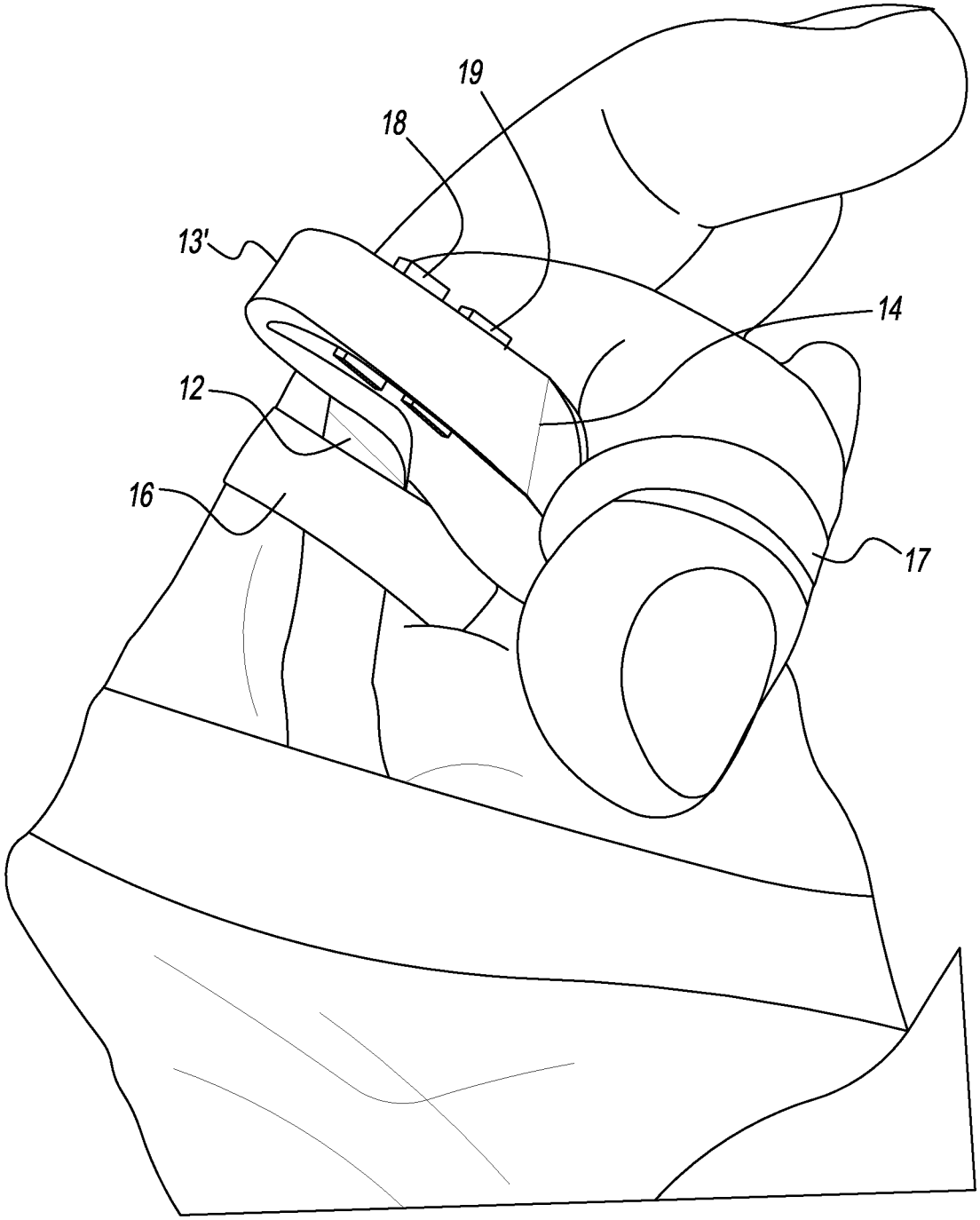
FIG. 6 is a perspective view of the exemplary embodiment of FIG. 1 mounted on a guitar player's left index finger and shown with the index finger fully curled.

FIG. 5 illustrates that as the index finger begins to curl, a strip portion 10 (or 10') trapped between attachment-points 16 and 17 compress the strip 10 (or 10') causing shape-memory creases 12, 13, 14 to fold along their crease lines. Thus strip 10 (or 10') commences to twist to the thumb side of the hand and avoids being caught within the curled index finger. The view of FIG. 6 shows the index curled to the maximum with strip 10 (or 10') off to the thumb side. An example of a non-barre chord, C-Major, is provided in FIG. 9 where strip 10 (or 10') is folded to the thumb side.

Operations Section: Force Vectors of the Index Finger Barre Chord

This discussion of force mechanics applies most directly to cross-over and classical guitars where only the pad of the thumb touches the back of the guitar neck; the neck is too wide for the left thumb to reach over to the bass strings. That said the reader may well see application of this analysis to the playing of thinner necked guitars.

FIGS. 10A and 11A show the barre chord device in use. In both drawings, one sees a barre and individual fingers pressing the guitar strings. On the other side of the guitar neck one sees the proximal phalanx of the thumb 102. The distal phalanx of the thumb is out of sight touching the back of the guitar neck. A first thought regarding the forces exerted might suggest a pinching action between the thumb and fingers as the thumb presses on the neck and the fingers squeeze against the strings. Only a man with a very strong thumb could balance the force of a barre chord with his thumb alone.

Right-arm-pads 100 are shown in FIGS. 10A and 11A. They rest atop the guitar lower bout and under the right arm. Those right-arm-pads 100 are integral to the force analysis of barre chords. The lower bout where guitar-top meets guitar-side has an edge which is uncomfortable to the forearm. A commercial product which distributes pressure evenly over the entire forearm is the LUVA ARM PAD. Many classical players create their own protective pads. The pads shown in FIGS. 10A and 11A, can be a Ziploc® quart freezer bag full of packing peanuts attached above and below the bare elbow with Alliance® Rubber Company X-Treme™ File Bands.

Famous Canadian luthier William "Grit" Laskin was the first (in 1989) to bevel a smooth edge into the lower bout of a guitar. He explained in the Sep. 16, 2009 issue of "Premier Guitar" magazine that a classical player who "was fed up with leaning on that edge" motivated the incorporation of the bevel. For that innovation Laskin received accolades from players as well as doctors. Many other luthiers have followed Laskin's lead. A guitar with a beveled lower bout is not a necessity for successful barre chords but it would certainly help by spreading pressure over a greater forearm area.

The player shown in FIGS. 10A and 11A rests the guitar on the near leg. For this analysis of barre forces however, the guitar could just as well rest on the opposite leg as classical players often do. In either case the knee must be higher than the hip so the guitar will tend to slide toward the player. When the player leans on right-arm-pad 100, the guitar presses firmly against the player's ribs. With the guitar solidly held in this way the player can pull the left hand back forcing the barre (and other left-hand fingers) onto the guitar strings. The active muscles are those at the back of the left shoulder—the same muscles one would use to pull the reigns of a horse or the oar of a row boat. The left thumb at the back of the guitar neck does not exert itself. Many players of classical guitars use this same force dynamic (where fret pressure comes from the left shoulder) for all chords and scales. Because of the significant force needed for barre chords it is particularly necessary to employ the large muscles of the shoulder and particularly necessary to have a good right-arm-pad 100 under the right forearm.

Classical guitars are particularly suited to this force dynamic. The classical guitar waist is narrow relative to the upper and lower bouts so the guitar fits around the top of the support leg. The guitar body is deep yielding plenty of contact surface along the leg. This large contact footprint of guitar on the support leg results in good stability as the right arm applies downward force to the lower bout through right-arm-pad 100.

Narrow-necked steel-stringed acoustic guitars come in a variety of shapes and sizes from "jumbo" to "parlor". Those players whose acoustic guitars are shaped so as to be difficult to stabilize on the support leg with pressure from the right forearm may have difficulty using the force dynamic described here. The owner of a narrow necked acoustic needs to make his own judgement as to whether his instrument can be securely held under a padded right arm and, as a consequence, whether he might benefit from embodiments of the barre chord device.

The barre chord device has several features which reduce the effort required to perform a six-string barre on a guitar of 1⅞" to 2" nut width. Equally important, the barre chord device does not interfere with using the left index fingertip for non-barre chords and musical scales. Applicability to narrow-necked instruments depends upon instrument and player.

When the guitar musician holds his index finger straight to perform a barre chord, the strip of the barre chord device is pulled straight by attachment points to the finger and heat formed memory-creases are not utilized. When the guitar musician curls his index to fret a note with his fingertip, the strip of the barre chord device is constrained by attachment points and memory-creases become folds which direct the barre chord device off to the thumb side of the hand rather than being trapped within the curled index finger. The barre chord device is flexible so that the transition into and out of barre chord formation requires very little effort and no unnecessary movement.

The narrow width of the strip of the barre chord device allows for concentrated force to the guitar strings close to the desired fret to maximize string-to-fret contact.

In a bare finger barre, the index finger stretches an arc of string as wide as the finger itself. The much narrower strip of the barre chord device stretches less string and thus requires less force.

The strip of the barre chord device builds out the concave middle finger to the prominence of the tip and middle joints to provide uniform barre pressure across all six guitar strings.

From the foregoing, it will be observed that numerous variations and modifications may be effected without departing from the spirit and scope of the invention. It is to be understood that no limitation with respect to the specific apparatus illustrated herein is intended or should be inferred.

I claim as my invention:

1. A barre chord device, comprising:

a resilient strip;

a plurality of attachments to bind a finger-side of said strip to an index finger, the strip extending along a length of the index finger; and shape-memory creases formed into said strip at a plurality of locations to cause the strip to bend in a lateral direction between two of the plurality of attachments, when the index finger is curled.

2. The barre chord device of claim 1, further comprising a plurality of shims attached to said strip at positions on the strip corresponding to the index finger at its middle phalanx.

3. The barre chord device of claim 1, wherein the each of the attachments comprises one selected from tape, rubber rings, and elastic fabric.

4. The barre chord device of claim 1, wherein the each of the attachments comprises an attachment loop which includes a mid-finger sleeve-with-guide, fitting around the index finger with a smaller guide channel fitting around said strip.

5. The barre chord device of claim 1, further comprising shims attach to the finger side of said strip to contact the index finger at its proximal phalanx.

6. The barre chord device of claim 1, further comprising shims attach to the finger side of said strip to contact the index finger at its distal phalanx.

7. The barre chord device of claim 1, wherein the shape-memory creases comprise a first crease located at the proximal phalanx, a second crease located at the middle phalanx and a third crease located at the distal phalanx, wherein the creases direct a bent portion of the strip to displace toward the thumb direction when the index finger is curled.

8. The barre chord device of claim 7, wherein the first and third creases is formed along a direction that is oblique to a transverse width of the strip.

9. The barre chord device of claim 1, wherein the attachments comprise two finger attachments which are located on the strip corresponding to the distal phalanx and proximal phalanx.

10. The barre chord device of claim 9, wherein the two finger attachments comprise bands.

11. The barre chord device of claim 1, wherein one of the attachments comprises an attachment loop having a mid-finger sleeve and a guide loop, the sleeve fitting around the index finger and the guide loop surrounding the strip.

12. The barre chord device of claim 1, wherein the strip is composed of rubber.

13. A barre chord device, comprising:

a strip of elastomeric material of pre-determined dimensions;

a plurality of attachment loops selected from the group consisting of: tape, rubber rings, and elastic fabric to bind a finger-side of said strip to the length of a user's index finger;

a plurality of shims of pre-determined dimensions which attach to the finger-side of said strip to contact the index finger at its middle phalanx; and shape-memory creases formed into said strip at a plurality of locations to cause the strip to bend in a lateral direction between two of the plurality of attachments loops.

14. The barre chord device of claim 13, wherein the plurality of attachment loops includes a mid-finger sleeve and a guide loop, the sleeve fitting around the index finger and the guide loop surrounding the strip.

15. The barre chord device of claim 13, further comprising shims attached to a finger side of said strip to contact the index finger at its proximal phalanx.

16. The barre chord device of claim 13, further comprising shims attached to a finger side of said strip to contact the index finger at its distal phalanx.

* * * * *